US005280258A

United States Patent [19]

Opperthauser

[11] Patent Number: 5,280,258

[45] Date of Patent: Jan. 18, 1994

[54] SPRING-POWERED OPERATOR FOR A POWER CIRCUIT BREAKER

[75] Inventor: Ray W. Opperthauser, Brandon, Miss.

[73] Assignee: Siemens Energy & Automation, Inc., Alpharetta, Ga.

[21] Appl. No.: 887,252

[22] Filed: May 22, 1992

[51] Int. Cl.[5] ..... H01H 9/00

[52] U.S. Cl. ..... 335/162; 335/185; 200/400

[58] Field of Search ..... 335/167-176, 185-190; 200/400

[56] References Cited

U.S. PATENT DOCUMENTS 4,968,861 11/1990 Kuhn ..... 200/400

5,148,913 9/1992 Bonnardel et al. ..... 200/400

*Primary Examiner*—Lincoln Donovan

[57] ABSTRACT

A spring-powered operator controls a high power circuit breaker by discharging an energy storing spring to rapidly close the circuit breaker against the bias of its internal opening springs, and latches to keep the circuit breaker closed until the receipt of a trip command which unlatches the operator and allows the circuit breaker to open. In response to discharging the energy storing spring, the operator immediately starts charging again in order to prepare for another closing of the circuit breaker. The operator uses a relatively low-power motor to drive a ratchet wheel that indirectly compresses the energy storing spring through a crank mechanism and, upon a release of the spring, uses a cam driven by the spring to act directly on a lever coupled to the breaker. The operator has a low number of parts and is able to close a circuit breaker particularly rapidly and reliably.

20 Claims, 7 Drawing Sheets

SPRING-POWERED OPERATOR FOR A POWER CIRCUIT BREAKER

BACKGROUND AND SUMMARY OF THE INVENTION

The invention is in the field of electrical circuit control and protection. More specifically it relates to an operator which controls a circuit breaker by rapidly closing it against the force of the breaker's opening mechanism and keeping the breaker closed but, when needed, permitting the circuit breaker's opening mechanism to rapidly open the circuit breaker in order to disconnect a load from a power source.

In normal circuit operation, circuit breakers can serve to energize and deenergize loads while under abnormal conditions, such as electrical shorts or sustained overloads, they can be used to rapidly deenergize the load and thus protect equipment and the surroundings from possible damage. Particularly at higher power levels, such as in the case of the SP brand power breakers available from Siemens Energy and Automation, Inc., which are rated for 15 KV to 72 V and 40 KA, it is desirable to achieve very rapid circuit breaker opening and closing in order to reduce undesirable electrical transients. For rapid opening of an electro-mechanical circuit breaker using internal springs, such as in said SP brand, the internal springs of the circuit breaker must be sufficiently powerful. For rapid closing, the bias of these internal springs must be overcome positively and rapidly. A mechanism called an operator can be used to rapidly close one or more interrupters (contacts) against the force of opening springs which are a part of the breaker and to permit rapid opening of the interrupters.

Different types of such operators have been proposed, including examples which use springs to store energy that can be rapidly released to close a circuit breaker and examples which use pneumatic mechanisms. An example of a pneumatic operator is available from Siemens Energy and Automation, Inc. under the designation Pneumatic Operator Mechanism SA-7. While known operators have many desirable features, it is believed that a need still remains for an improved operator having high reliability and functionality and an improved balance of other characteristics. This invention is directed to meeting such a need.

An exemplary spring-powered operator embodying the invention controls a circuit breaker having an opening mechanism which is charged when the breaker closes and which when allowed to discharge opens the circuit breaker. This opening mechanism can be internal springs of a circuit breaker such as a breaker carrying said SP brand. The operator has a lever coupled with the circuit breaker's opening mechanism and constrained to move between an open position at which the circuit breaker is open and a closed position at which the circuit breaker is closed. A first charge command is provided when the lever is at its open position and therefore the circuit breaker is open. In response to this first charge command, the operator charges an energy storing spring, e.g., compresses the spring, and latches the spring at its charged position. When it is time to close the circuit breaker, a discharge command is provided and, in response, the operator unlatches the spring and allows it to discharge. The operator uses the energy released by the discharging spring to rotate a cam that engages the lever coupled to the circuit breaker and moves that lever from its open to its closed position to thereby close the circuit breaker, and latches the lever at its closed position to thereby keep the circuit breaker closed. This discharging of the spring also generates a second charge command and, in response, the operator again starts charging the energy storing spring and then latches it in its charged position. If and when a trip signal is received, i.e., when the circuit breaker should be opened, the operator unlatches the lever from its latched position to thereby allow the circuit breaker's opening mechanism, e.g., the breaker's internal springs, to open the circuit breaker. Because the operator has charged immediately after closing the circuit breaker, it is ready to immediately respond to a discharge command and again close the circuit breaker.

In the disclosed example of the invention, the operator charges itself by using an electric motor to indirectly drive a ratchet wheel which in turn indirectly rotates a crank pulling a rod that compresses the energy storing spring to its charged position. To discharge, the operator releases the spring and the expanding spring rotates the crank through the same rod. This crank rotation in turn rotates the cam which strikes the lever connected through a linkage to the circuit breaker, e.g., to the breaker's interrupters, to move the interrupters against the force of the circuit breaker's opening mechanism, e.g., opening springs, and to thereby rapidly and safely close the circuit breaker. The sequence for the operator is: charge, discharge to close the circuit breaker, and immediately charge again to be ready for the next closing of the circuit breaker. The operator allows the circuit breaker to open at any time. The disclosed embodiments of the invention use a particularly low number of parts and relatively simple components and interaction of components, which is believed to improve reliability, and are believed to be particularly effective in achieving a rapid and positive closing of circuit breakers in high power circuits and in allowing rapid opening of such circuit breakers.

The drawings are approximately to scale.

DETAILED DESCRIPTION

Figure 1:
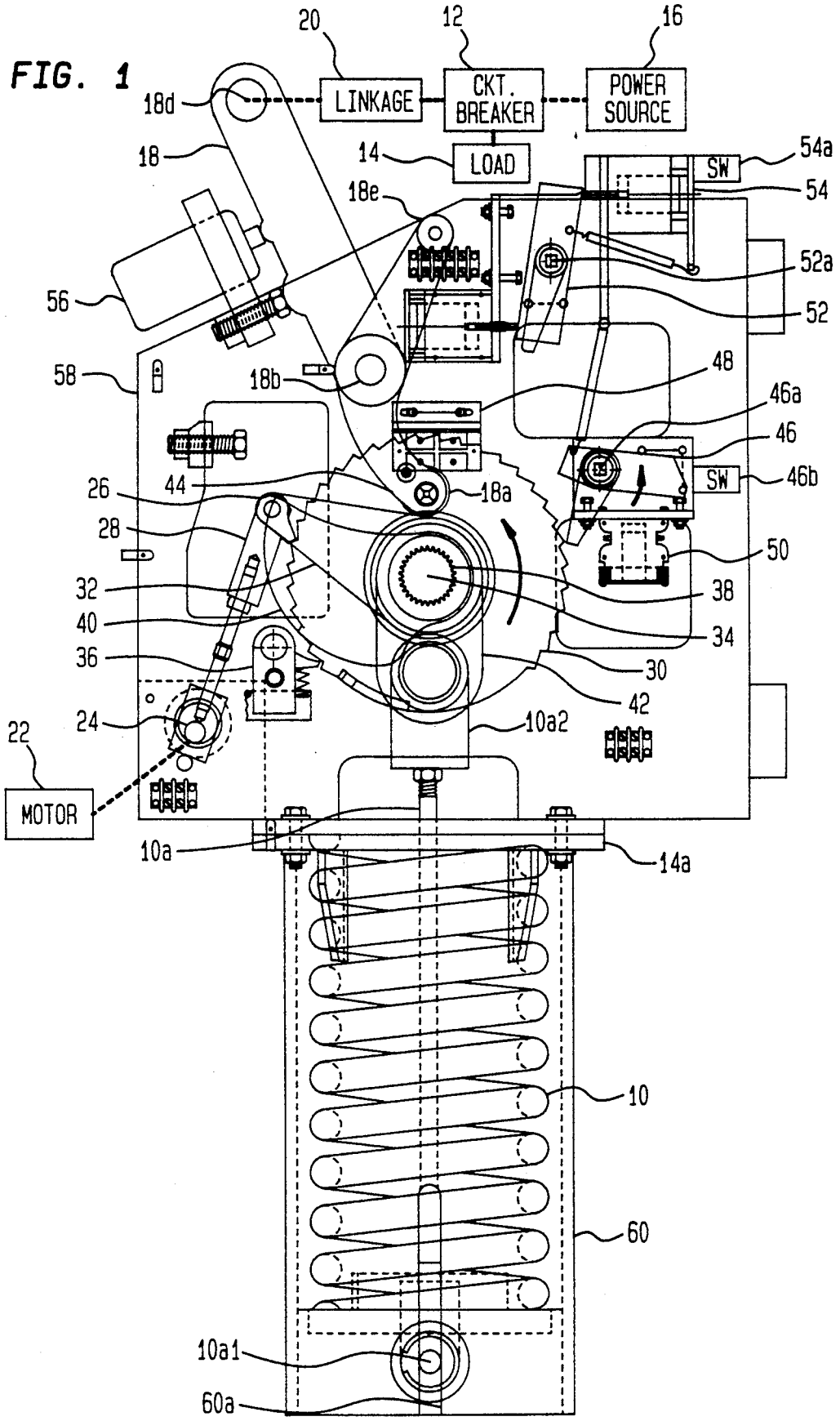
FIG. 1 illustrates an operator which embodies the invention and is in a discharged position and a circuit breaker controlled thereby is open.
Figure 2:
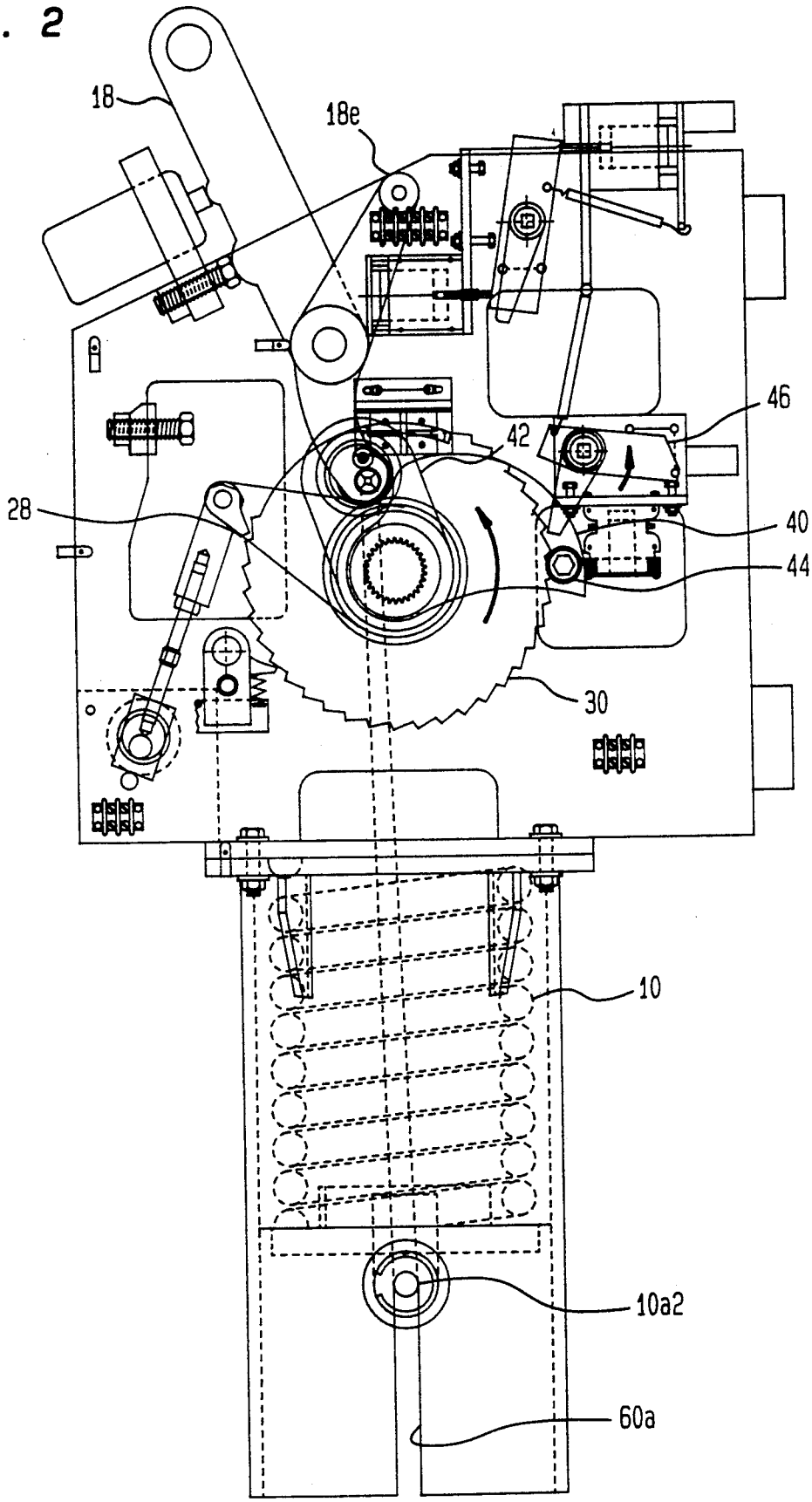
FIG. 2 is otherwise similar to FIG. 1 but shows a position in which the operator is charged while the breaker is and remains open.
Figure 3:
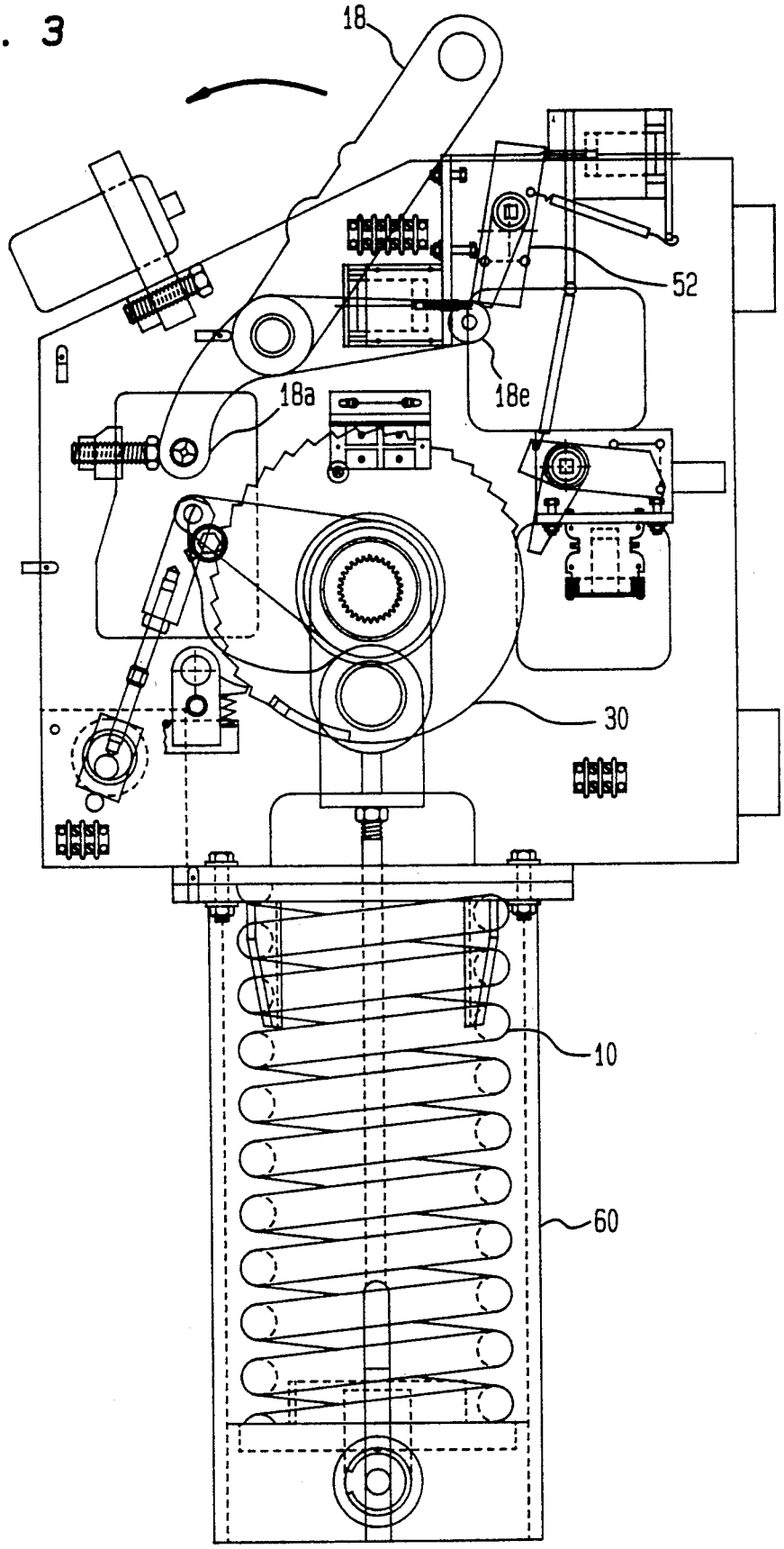
FIG. 3 is otherwise similar to FIG. 1 but shows a position in which the operator is discharged and the breaker is closed.
Figure 4:
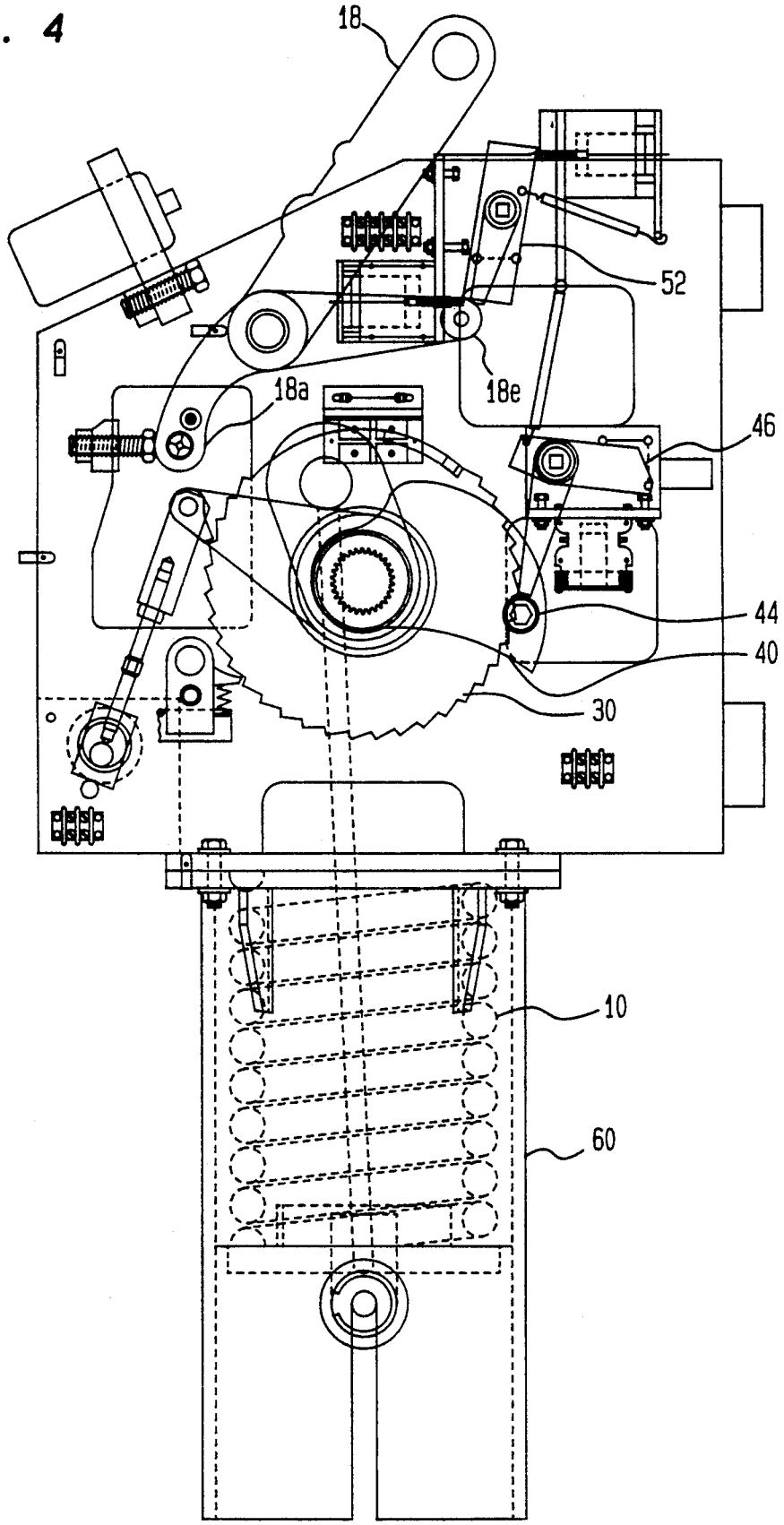
FIG. 4 is otherwise similar to FIG. 1 but shows a position in which the operator is charged while the breaker is and remains closed.

FIGS. 1–4 illustrate a first embodiment of the operator. FIG. 2 shows the result of a first charging cycle used when the controlled circuit breaker is open, and FIG. 4 shows the result of a second charging cycle which starts with the closing of the circuit breaker.

Referring to FIGS. 1–4, the operator comprises an energy storing spring 10 having a charged position shown in FIGS. 2 and 4 in which it stores energy and releasing energy when allowed to discharge to its position shown in FIGS. 1 and 3. The operator controls a circuit breaker 12, which can be said SP brand breaker, and has an internal breaker opening mechanism such as a mechanism using opening springs. When closed, breaker 12 connects a load 14, such as a subtransmission line, to a power source 16, such as a power grid step-down transformer. The operator includes a lever 18 which is coupled with the internal opening mechanism of circuit breaker 12 through a linkage 20 which can be the same as that coupling said SA-7 pneumatic operator to said SP brand circuit breaker. Lever 18 moves between an open position shown in FIGS. 1 and 2 at which circuit breaker 12 is open and a closed position shown in FIGS. 3 and 4 at which circuit breaker 12 is closed. The operator includes a source that selectively provides a first charge command given at a time when lever 18 is at its open position, a discharge command given at a time spring 10 is at its charged position, and a trip command given at a time when circuit breaker 12 is at its closed position, and which generates a second charge command when spring 10 is being discharged. This source of command signals can comprise a switch 48 discussed below and inputs for a discharge signal to a close solenoid 46 and a trip solenoid 52 (or, alternatively, switches **46*b* and 54*a*** for energizing the respective solenoids).

In FIG. 1 the operator is discharged and the circuit breaker is open. To prepare the operator for closing circuit breaker 12, the operator receives a first charge command and in response activates a charging mechanism to charge energy storing spring 10 by compressing it from its discharged position shown in FIG. 1 to its charged position shown in FIG. 2, and latches spring 10 at that charged position. Meanwhile, circuit breaker 12 remains open and therefore keeps load 14 disconnected from power source 16. To thereafter close circuit breaker 12 and thereby connect load 14 to power source 16, in response to a discharge command the operator activates a discharge mechanism to unlatch spring 10 to allow it to move from its charged position shown in FIG. 2 to its discharged position shown in FIG. 3. The operator's lever driving mechanism uses the energy which spring 10 releases while expanding toward its FIG. 3 position to rapidly move lever 18 from its breaker open position shown in FIG. 2 to its breaker closed position shown in FIG. 3. This movement of lever 18 operates circuit breaker 12 through linkage 20 to rapidly close circuit breaker 12 against the bias force of its internal springs (not shown). The operator then latches lever 18 at its closed position to thereby maintain circuit breaker 12 closed and load 14 connected to power source 16. When the operator thereafter receives a trip command, i.e., a command for opening circuit breaker 12 such as in order to prevent damage due to an electrical overload, the operator activates a trip mechanism to unlatch lever 18 to allow the internal springs of circuit breaker 12 to open the circuit breaker and thereby disconnect load 14 from source 16. In order to prepare the operator for a subsequent closing of circuit breaker 12, the operator provides a second charge command when spring 10 is being discharged and in response starts another charging cycle immediately after discharging. In this second charging cycle, the operator again charges spring 10, this time by moving it from its discharged position shown in FIG. 3 to its charged position shown in FIG. 4. However, meanwhile lever 18 is at its closed position seen in FIG. 4. While the operator is in the state shown in FIG. 4, the receipt of a trip command unlatches lever 18 and allows it to move to its position shown in FIGS. 1 and 2, but spring 10 remains in its charged position shown in FIG. 4, ready to discharge and again close circuit breaker 12 in response to-a discharge signal.

For simplicity and conciseness, certain elements (12, 14, 16, 20, 22, **46*b* and 54*a***) are shown only schematically in FIG. 1 and are omitted from FIGS. 2–4. These elements can but need not be the same as or similar to those used with the SA-7 pneumatic operator identified earlier. For this reason, and also because such elements are believed to be known to those of ordinary skill in the pertinent technology, they are not described in greater detail below.

The operator's charging mechanism, which is coupled with the spring and the source of the commands and is responsive to each of the first and second charge commands to charge spring 10 and maintain it charged (until the receipt of a discharge command), comprises an electric motor 22 with an integral gearbox. In response to either of the charge commands, motor 20 is enabled to turn an eccentric shaft 24 to thereby oscillate a link 26. The first charge command can be the manual closing of a switch (such as switch 48 described below) to supply power to motor 12, or it can be a remote signal closing a switch (such as switch 48) to supply power to motor 20. The second charge command is generated by switch 48 when spring 10 is being discharged, as described below. Link 26 carries a drive pawl 28 which can but need not be biased against ratchet wheel 30 by a spring **28*a*. Drive pawl 28 is constrained by an arm 32 to a path concentric with a toothed ratchet wheel 30 to engage its teeth. Wheel 30 is splined to a splined shaft 38 to rotate about an axis 34 but arm 32 is journalled at a non-splined part of shaft 38 to rotate freely about the same axis 34. The dimensions of the relevant components are such that one oscillatory cycle of link 26 and drive pawl 28 is sufficient to rotate ratchet wheel 30 counterclockwise ("CCW") as seen in FIG. 1 about axis 34 through an angle slightly greater than the angle of one tooth of ratchet wheel 30 (and link 26 is adjustable in length to help achieve this relationship). A holding pawl 36 is urged against the teeth of ratchet wheel 30 by a spring 36*a* and keeps ratchet wheel 30 from counter-rotation, i.e., from clockwise ("CW") rotation as seen in FIG. 1, on the return stroke of drive pawl 28. A cam 40 and a crank 42 also are splined on the same splined shaft 38 to rotate together with each other and with arm 32. The charging mechanism continues to rotate ratchet wheel 30, and thereby cam 40 and crank 42 as well, in the described manner until crank 42 passes its top dead center position. After that point, the force of energy storing spring 10 causes ratchet wheel 30 to rotate CCW to the position shown in FIG. 2. As seen in FIGS. 1–4, spring 10 is coupled to crank 42 and, through splined shaft 38, to ratchet wheel 30 through an adjustable rod 10*a*. Rod 10*a* is affixed at its bottom end to a pin 10a1 to support spring 10, and is affixed at its top end to a rod end 10a2 which is journalled at a pin projection 42a affixed to crank 42. Spring 10 is thus restrained between pin 10a1 and a plate 58a mounted to a frame 58 which supports all of the operator's components. The dimensions are such that spring 10 is somewhat under compression even when in its discharged position. The charging cycle ends when a latch roll 44 carried on cam 40 comes to rest against a close latch 46. At this position, drive pawl 28 contacts ratchet wheel 30 in an area that has no teeth, and can oscillate freely. However, since the charging cycle is over and there is no further need to operate motor 22, an electrical switch 48 is actuated by a cam (not seen) which is integral with the face of ratchet wheel 30 to disable motor 22 and thereby discontinue the rotation of eccentric shaft 24. The operator is now charged, and the charging mechanism maintains spring 10 in its charged position because latch roll 44 remains pressed against close latch 46 to thereby keep splined shaft 38** from further CCW rotation.

The discharging mechanism which is coupled with spring 10 and the source of the discharge command and is responsive to the discharge command to discharge spring 10, comprises a close solenoid 50 which, when energized, rotates close latch 46 CCW about an axis 46a to thus release latch roll 44 and allow CCW rotation of ratchet wheel 30 under the influence of energy storing spring 10. This allows spring 10 to expand to its discharged position shown in FIG. 3. The discharge command can be generated by a switch 46a which can be manually operated (or operated by a remote signal) to energize solenoid 50 when it is desired to close circuit breaker 12.

The operator's lever driving mechanism which is coupled with spring 10 and is driven by its discharge to drive lever 18 to and maintain it at its closed position shown in FIGS. 3 and 4, thereby closing circuit breaker 12 and maintaining it closed to connect load 14 to power source 16, comprises cam 40 which acts directly on lever 18. While spring 10 is discharging, it acts on crank 42 to rotate ratchet wheel 30 ccw, and thereby also rotate cam 40 CCW, from the positions shown in FIG. 2 to those shown in FIG. 3. In the course of this CCW rotation, cam 40 engages a cam follower 18a which is an integral part of lever 18 and forces lever 18 to rotate CW about an axis 18b. Because lever 18 is connected at 18d through linkage 20 to circuit breaker 12, this CCW rotation of lever 18 about axis 18b moves the interrupters (not shown) in circuit breaker 12 to their closed position and charges the opening springs (not shown) in circuit breaker 12. As crank 42 approaches its bottom dead center position, cam 40 disengages from and clears cam follower 18a. At this position, a latch roll 18e which is a part of lever 18, comes to rest against a trip latch 52, as seen in FIG. 3. This engagement of latch roll 18e and trip latch 52 holds lever 18 in its closed position against the force of the opening springs (not shown) of circuit breaker 12 and thereby maintains circuit breaker 12 in its closed position in which load 14 is connected to power source 16.

The discharge command immediately causes the generation of the second charge command because the release of ratchet wheel 30 by the operation of close solenoid 50 trips electrical switch 48 (through a cam which is integral with ratchet wheel 30 but is not seen in the drawings) to again turn on power to electric motor 22. This in turn causes ratchet wheel 30 to again start its CCW rotation as described above, until energy storing spring 10 again comes to a charged position as shown in FIG. 4. This charging operation is the same as described in connection with the change from FIG. 1 to FIG. 2, except that this time lever 18 is and remains in its closed position shown in FIGS. 3 and 4 because trip latch 52 continues to hold latch roll 18e.

To open circuit breaker 12, such as when necessitated by an overload condition, the operator receives a trip command which closes a switch 54a to energize a trip solenoid 54 which rotates trip latch 52 CCW about its axis 52a. This releases latch roll 18e and allows the charged opening springs (not shown) of circuit breaker 12 to drive lever 18 (through linkage 20) CCW about axis 18b toward its open position shown in FIG. 1., Near the end of this CCW rotation of lever 18 about axis 18b, lever 18 engages a dashpot 56 to dissipate the remaining kinetic energy and to rest lever 18 at its open position shown in FIG. 1.

The components discussed above are mounted on frame 58 and energy storing spring 10 is housed in a partially slotted sleeve 60 mounted on frame 58 by means of bolts as shown in FIGS. 1–4. Pin 10a1 carries at its ends bearings riding in slots 60a in sleeve 60. For clarity and conciseness, the specification omits conventional mounting details which will be apparent from the description and drawings herein to those skilled in the relevant technology. The source of commands discussed above can be manual switches or inputs for remote command signals or a combination thereof, and can be similar to the source of commands for said SA-7 pneumatic operator.

Referring to FIGS. 5–12, an alternative and currently preferred embodiment of the operator is and operates substantially the same as that shown in FIGS. 1–4 except as discussed below. The same reference numerals are used for elements which are substantially the same.

Figure 6:
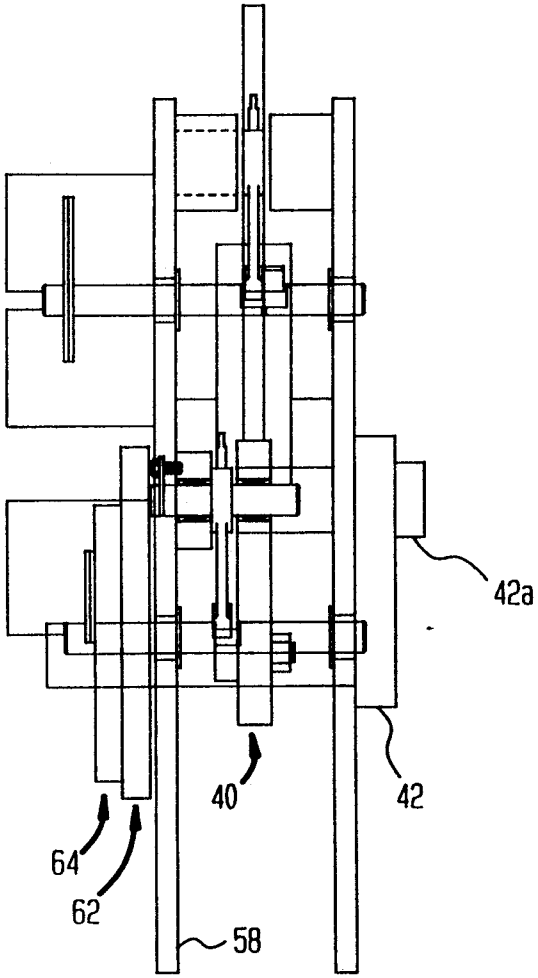
FIG. 6 is a side view of the portion shown in FIG. 5.
Figure 5:
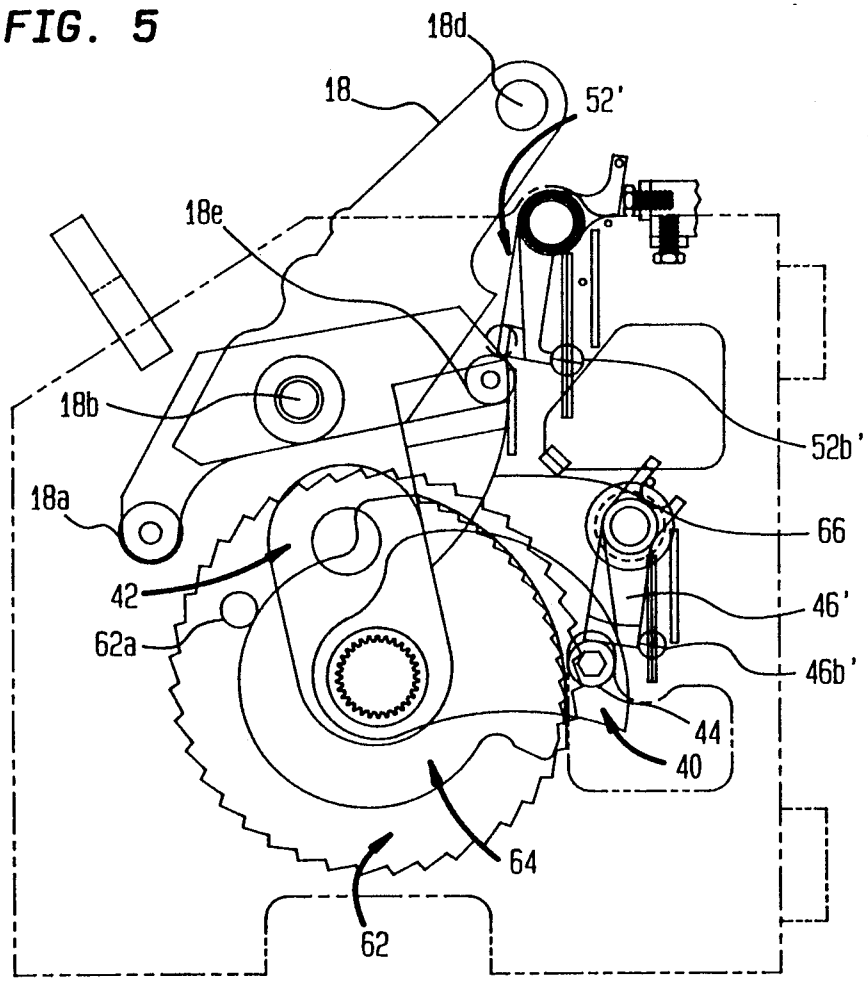
FIG. 5 illustrates a portion of a preferred embodiment of the operator and shows a position in which the operator is charged and the breaker is closed.
Figure 8:
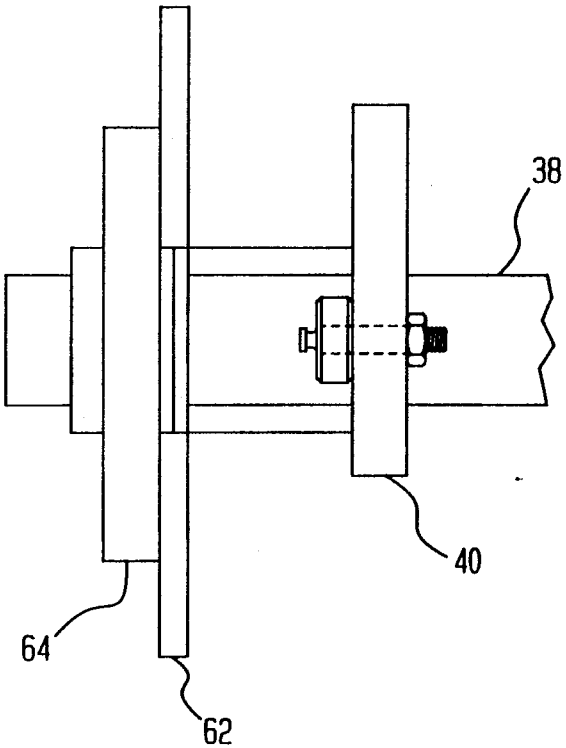
FIG. 8 is a side view of the same detail.
Figure 7:
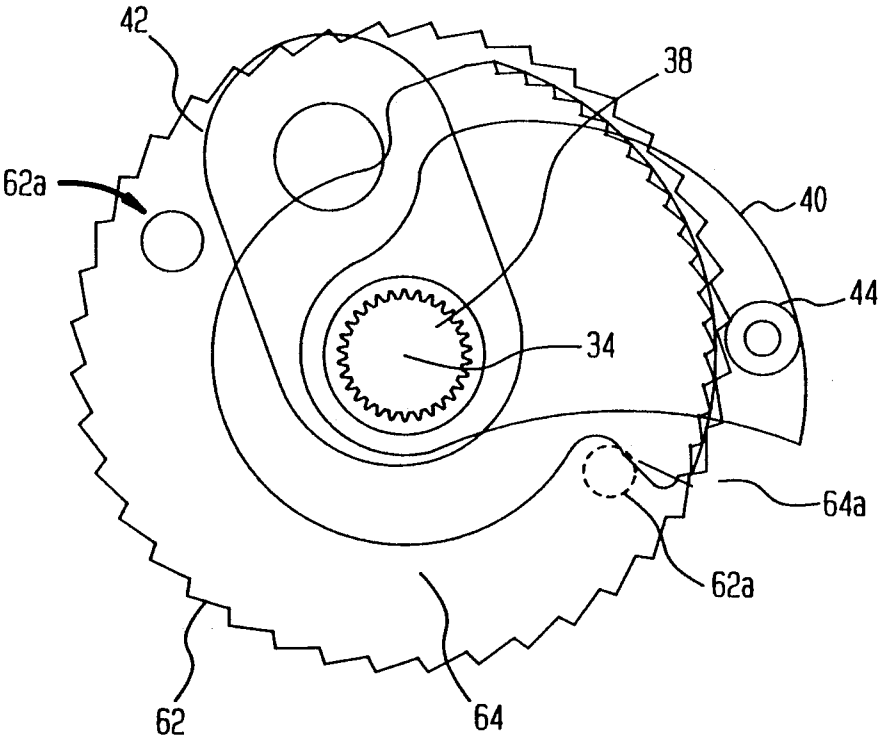
FIG. 7 is a detail of the portion shown in FIG. 5.
Figure 10:
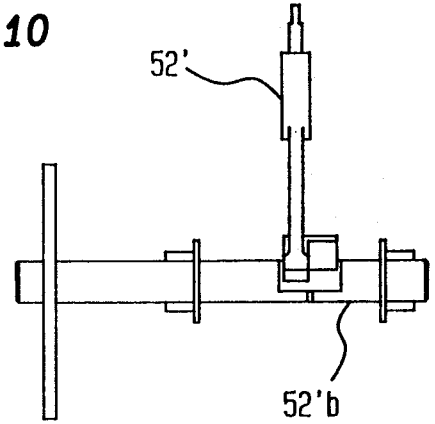
FIG. 10 is a side view of the same detail.
Figure 12:
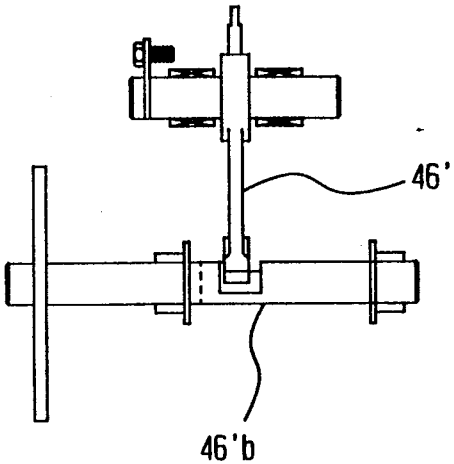
FIG. 12 is a side view of the same detail.
Figure 9:
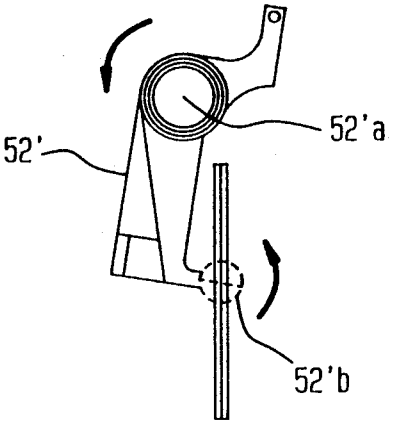
FIG. 9 is another detail of the portion shown in FIG. 5.
Figure 11:
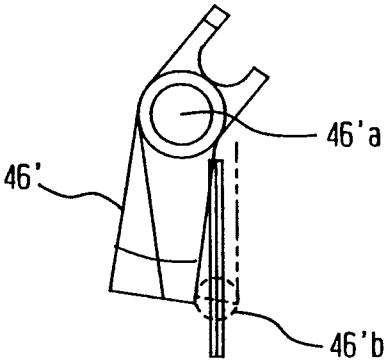
FIG. 11 is yet another detail of the portion shown in FIG. 5.

As seen in FIGS. 5–8, the currently preferred embodiment of the invention uses a ratchet wheel 62 which, unlike ratchet wheel 30, is not splined to shaft 38 but is mounted thereon for free rotation about the same axis 34. Wheel 62 carries a drive pin 62a which engages a drive wheel 64 splined to the same splined shaft 38 to which cam 40 and crank 42 are splined. Wheel 62 can therefore be driven by pawl 28 the same as wheel 30 to rotate splined shaft 38 and the elements splined to it. Drive wheel 64 has a portion 64a which extends radially outwardly of ratchet wheel 62 and is positioned to lift drive pawl 28 from engagement with the teeth of ratchet wheel 62 when the operator reaches its charged position. Another difference is the way the close and trip latches operate. In the preferred embodiment, as seen in FIGS. 11–12 and 5–6, when the operator is charged and circuit breaker 12 is closed, latch roll 44 bears against a close latch 46' and this stops the CCW rotation of splined shaft 38. Motor 22 is turned off at the same time as earlier described. Close latch 46' in the preferred embodiment has a rounded face bearing against latch roll 44, as best seen in FIGS. 5 and 11, and the shape and position of the rounding are such that unless kept from Ccw rotation about its axis 46'a, i.e., at the position shown in FIGS. 5 and 11, by a notched shaft 46'b, close latch 46' would allow further rotation of splined shaft 38. Thus, when close latch 46' should maintain spring 10 at its charged position, notched shaft 46'b is in its position shown in FIG. 11 to keep close latch 46' in the position shown in FIGS. 5 and 11, and thus to keep the operator charged. When it is time to discharge the operator, a solenoid (not shown in FIGS. 5–12) rotates notched shaft 46'b through an angle sufficient to allow the lower end of close latch 46' to enter the notch in shaft 46'b. This permits the upward force of latch roll 44 to rotate close latch 46' CCW about axis 46'a, and this allows splined shaft 38 to rotate further Ccw under the force of spring 10. A similar arrangement is used for a trip latch 52' seen in FIGS. 9–10 and 5–6. Trip latch 52' keeps lever 18 in the position shown in FIG. 5 by bearing against latch roll 18e. Again, the relevant face of trip latch 52' is rounded and positioned such that unless restrained trip latch 52' would rotate CCW about its axis 52'a when loaded by the upward bias on latch roll 18e due to the force of spring 10. To prevent that, trip latch 52' is kept in the position shown in FIGS. 5 and 9 by a similar notched shaft 52'a. When it is time to discharge the operator from the position shown in FIG. 5, a solenoid (not shown in FIGS. 5–12) rotates shaft 52'b through a sufficient angle to allow the lower end of trip latch 52' to enter the notch in shaft 52'b and thereby to allow trip latch 52' to clear latch roll 18e and permit lever 18 to pivot CCW about its axis 18b. A cam 66 is affixed to lever 18, as seen in FIGS. 5–6, and serves to keep trip latch 52' from moving to its latched position shown in FIG. 5 when the circuit breaker is open and lever 18 has rotated CCW from its position shown in FIG. 5. While lever 18 in the preferred embodiment has a different shape from that in the embodiment of FIGS. 1–4, and is welded rather than cast, it serves substantially the same function and operates in substantially the same way, as do the other elements of the preferred embodiment. In the case of each of trip latch 52' and close latch 46' the center of curvature of the latch face bearing against the respective latch roll (18e or 44) is offset from the axis of latch rotation such that unless locked in position, the force of the latch roll against the latch would rotate the latch CCW and would allow the latch roll to clear the latch.

In the particular examples of the disclosed operator embodiments, which can conveniently control a circuit breaker of the SP brand identified above, the operator and the circuit breaker typically are housed in the same cabinet. Spring 10 preferably is a steel compression coil spring selected to be able to store sufficient energy to overcome the circuit breaker's opening springs, e.g., to store about 1.7 KJoules. Rod 10a typically is adjustable in length to allow spring 10 to be placed under some initial load. Pin 10a1 carries bearings such as DU brand Teflon impregnated metal substrate bearings available from Garlock which ride in slots 60a of sleeve 60. Lever 18 can be a steel lever having the illustrated shape and having dimensions selected to provide the required stroke of the circuit breaker's interrupters. It can be case hardened at the two places where, as seen in FIGS. 1–4, it contacts dashpot 56. Cam follower roll 18a and latch rolls 18e and 44 can each comprise a bearing such as an airframe bearing type NBF available from The Torrington Company in Torrington, Conn., e.g. size 8 or 10 bearing as appropriate. Linkage 20 can be the same as used with the pneumatic operator SA-7 identified above. Motor 22 can be a universal AC/DC 1 HP nominal motor such as a motor available from the Lamb Electric Division of Ametek. Pawls 28 and 36 can each have a case hardened working tip. Each of ratchet wheels 30 and 62 has a nominal diameter of about 8" to the tooth crests. A 60-tooth wheel has been used but it is currently believed that a 90-tooth wheel is preferable (some of the teeth are removed in the first embodiments, as seen in FIGS. 1–4). The teeth are hardened steel. Arm 32 is made of steel; the coupling between this arm 30 and rod 26 (or drive pawl 28) may be changed by the addition of a DU type bearing. Splined shaft 38 can be 20-tooth hot-rolled stock of about 1.5" outside diameter. Cam 40 can be steel with a hardened working edge and crank 42 can be forged steel with pin 42a forged as a part of the crank and then machined. Close latches 46 and 46' and trip latches 52 and 52' can each be made of steel with a hardened working edge. The steel parts which are hardened or have hardened portions can be made of 4140 steel. Solenoids 50 and 54 can be parts available from DECCO in Detroit, Mich. while specific examples have been given of components used or contemplated to be used in the disclosed specific examples of the operator, it should be understood that the scope of the invention is not limited to the disclosed examples but is defined by the appended claims.

I claim:

1. A spring-powered operator for controlling a circuit breaker having an opening mechanism which is charged when the breaker closes and which when allowed to discharge opens the circuit breaker, said operator comprising:

an opening mechanism;

a lever coupled with the circuit breaker's opening mechanism and movable between an open position at which the circuit breaker is open and a closed position at which the circuit breaker is closed;

a rotatively mounted crank coupled to the circuit breaker;

a rod having a first end rotatively coupled to the crank and a second end distal the crank which is constrained to reciprocating motion by the crank along an axis generally perpendicular to the crank rotational axis;

an energy storing spring captured by the rod having a charged position at which it stores energy when the crank is at a top dead center position and releasing stored energy when allowed to discharge at a bottom dead center position of the crank;

a source selectively providing a first charge command when the lever is at its open position, a discharge command when the spring is at its charged position, and a trip command when the circuit breaker is closed, and providing a second charge command in response to a discharge of the spring;

a charging mechanism coupled with the spring and the source and responsive to each of said first and second charge commands to charge the spring;

a discharging mechanism coupled with the spring and the source and responsive to the discharge command to discharge the spring; and a lever driving mechanism coupled with the spring and driven by the discharge thereof to drive the lever to and maintain it at its closed position, thereby closing the circuit breaker and maintaining it closed; and a trip mechanism responsive to said trip signal to release the lever from its closed position and allow the circuit breaker to open.

2. A spring-powered operator as in claim 1 in which said charging mechanism comprises a rotatively mounted ratchet wheel, a driving pawl engaging the wheel and a motor coupled with and driving the pawl to impart rotary motion to the ratchet wheel, the crank coupled to and rotated by the ratchet wheel, and a close latch coupled with the crank and operative at a crank position which is adjacent to but past the crank's top dead center position to keep the crank from further rotation under the influence of the charged spring until said source provides said discharge command.

3. A spring-powered operator as in claim 2 in which said source comprises a switch generating said first charge command signal in response to an external input and generating said second charge command in response to rotation of the crank while the spring is being discharged.

4. A spring-powered operator as in claim 3 in which said discharge mechanism comprises a solenoid coupled with the close latch and the source and responsive to the discharge command to cause the close latch to release the crank and allow it to rotate further under the influence of the discharging spring.

5. A spring-powered operator as in claim 4 in which said lever driving mechanism comprises a rotationally mounted cam coupled with said crank to rotate therewith when the spring is being discharged and having a cam face engaging the lever to move it to its closed position during the course of said discharging of the spring, and a trip latch engaging the lever upon its reaching its closed position to maintain the lever at its closed position against forces exerted thereon by the circuit breaker's opening mechanism.

6. A spring-powered operator as in claim 5 in which said lever comprises a single, substantially rigid lever, wherein the operator includes means for mounting the lever for pivotal movement thereof between the lever's open and closed positions about a pivot axis.

7. A spring-powered operator as in claim 6 in which said lever comprises a first single arm extending from the pivot axis toward the cam, a second single arm extending from the pivot axis toward the coupling with the linkage to the circuit breaker, and a third single arm extending from the pivot point toward the part of the lever engaging said trip latch.

8. A spring-powered operator as in claim 2 in which said lever driving mechanism comprises a rotationally mounted cam coupled with said crank to rotate therewith when the spring is being discharged and having a cam face engaging the lever to move it to its closed position during the course of said discharging of the spring, and a trip latch engaging the lever upon its reaching its closed position to maintain the lever at its closed position against forces exerted thereon by the circuit breaker's opening mechanism.

9. A spring-powered operator as in claim 1 in which said lever driving mechanism comprises a rotationally mounted cam coupled with said spring to rotate from a first position held when the spring is at its charged position to a second position held when the spring is at its discharged position, said cam having a cam face engaging the lever at a time when the spring is being discharged to move the lever to its closed position, and a trip latch engaging the lever upon its reaching its closed position to maintain the lever at its closed position against forces exerted thereon by the circuit breaker's opening mechanism.

10. A method of controlling a circuit breaker having an opening mechanism which is charged when the breaker closes and which when allowed to discharge opens the circuit breaker, said method of controlling the circuit breaker comprising:

providing an opening mechanism;

coupling a lever with the circuit breaker's opening mechanism;

constraining the lever to move between an open position at which the circuit breaker is open and a closed position at which the circuit breaker is closed;

providing a first charge command when the lever is at its open position;

providing a rotatively mounted crank coupled to the circuit breaker and a rod having a first end rotatively coupled to the crank and a second end distal the crank which is constrained to reciprocating motion by the crank along an axis generally perpendicular to the crank rotational axis;

in response to said first charge command, charging an energy storing spring captured by the rod having a charged position at which it stores energy when the crank is at a top dead center position and releasing stored energy when allowed to discharge at a bottom dead center position of the crank, and latching the spring at a charged position;

providing a discharge command at a time when the spring is at its latched position;

in response to said discharge command, unlatching the spring and allowing it to discharge in response to said discharge command;

utilizing energy released by the discharging spring to rotate a cam through a path in which the cam engages the lever and moves it from its open to its closed position to thereby close the circuit breaker, and latching the lever at its closed position to thereby keep the circuit breaker closed;

in response to the discharging of the spring, providing a second charge command and, in response to the second charge command, again charging the energy storing spring and latching it in its charged position; and providing a trip signal at a time when the breaker is closed and, in response thereto, unlatching the lever from its latched position to thereby allow the circuit breaker to open and the lever to move to its open position.

11. A method as in claim 10 in which the step of coupling the lever with the circuit breaker's opening mechanism comprises utilizing a single, substantially rigid, pivoted lever to drive a linkage to the circuit breaker.

12. A method as in claim 11 in which the step of charging the spring and latching it at its charged position comprises utilizing a motor to drive a rotary ratchet wheel through a reciprocating drive pawl and coupling the wheel to the crank coupled with the spring to compress the spring in moving toward a top dead center of the crank, and a latch operative at a position past but adjacent the crank's top dead center to prevent further rotation of the crank under the influence of the compressed spring until the discharge command is provided.

13. A method as in claim 12 in which the step of utilizing energy released by the discharging spring to rotate the cam comprises splining the cam and the crank to the same splined shaft to thereby impart the crank's rotary motion to the cam.

14. A method as in claim 10 in which the step of charging the spring and latching it at its charged position comprises utilizing a motor to drive a rotary ratchet wheel through a reciprocating drive pawl and coupling the wheel to a rotary crank coupled with the spring to compress the spring in moving toward a top dead center of the crank, and a latch operative at a position past but adjacent the crank's top dead center to prevent further rotation of the crank under the influence of the compressed spring until the discharge command is provided.

15. A spring-powered operator for controlling a circuit breaker having an opening mechanism which is charged when the breaker closes and which when allowed to discharge opens the circuit breaker, said operator comprising:

an opening mechanism;

a lever mounted for pivoting about a pivot axis and coupled with the circuit breaker's opening mechanism to pivot about said axis between an open position at which the circuit breaker is open and a closed position at which the circuit breaker is closed;

an energy storing spring having a charged position at which it stores energy and releasing stored energy when allowed to discharge;

a source selectively providing a first charge command when the lever is at its open position, a discharge command when the spring is at its charged position, and a trip command when the circuit breaker is closed, and providing a second charge command in response a discharge of the spring; p1 a charging mechanism coupled with the spring and the source and responsive to each of said first and second charge commands to charge the spring, said charging mechanism comprising an electric motor, and eccentric shaft rotated by the motor, a connecting rod reciprocated by said eccentric shaft, a drive pawl drive by said reciprocating connecting rod, a splined shaft and a ratchet wheel rotated about the shaft axis by said pawl to rotate said shaft, a rotary crank splined on said shaft, said crank being coupled with said spring to compress the spring in moving toward a top dead center position of the crank, and a close latch operative at a position past and adjacent to the top dead center position of the crank to prevent further rotation of the crank about the shaft axis under the influence of the spring until the source provides said discharge signal;

a discharging mechanism coupled with the spring and the source and responsive to the discharge command to unlatch said latch and permit the spring to discharge; and a lever driving mechanism coupled with the spring and driven by the discharge thereof to drive the lever to and maintain it at its closed position, thereby closing the circuit breaker and maintaining it closed, said lever driving mechanism comprising a rotary cam splined to said shaft to rotate therewith when the discharging spring rotates the crank to move it toward a bottom dead position, said cam having a cam face engaging said lever in the course of the spring's discharge to pivot the lever to its closed position; and a trip mechanism responsive to said tip signal to release the lever from its closed position and allow the circuit breaker to open.

16. A spring-powered operator as in claim 15 in which said source comprises a switch generating said first charge command signal in response to an external input and generating said second charge command in response to rotation of the crank while the spring is being discharged.

17. A spring-powered operator as in claim 15 in which said discharge mechanism comprises a solenoid coupled with the close latch and the source and responsive to the discharge command to cause the close latch to release the crank and allow it to rotate further about the shaft axis under the influence of the discharging spring.

18. A spring-powered operator as in claim 15 in which said lever comprises a single, substantially rigid lever.

19. A spring-powered operator as in claim 15 in which said ratchet wheel is splined to the splined shaft to rotate with the crank.

20. A spring-powered operator as in claim 15 in which said ratchet wheel is mounted for free rotation about the splined shaft, wherein the charging mechanism comprises a drive wheel splined to the drive shaft and the ratchet wheel includes a drive pin engaging said drive wheel to thereby rotate the splined shaft and therefore the crank.

* * * * *